US005799561A

United States Patent [19]

Wetzel et al.

[11] Patent Number: 5,799,561

[45] Date of Patent: Sep. 1, 1998

[54] CONTROL DEVICE

[75] Inventors: Uwe Wetzel, Stockholm; Nils Svensson, Vagnhärad, both of Sweden

[73] Assignee: Ross Operating Valve Company, Troy, Mich.

[21] Appl. No.: 760,009

[22] Filed: Dec. 3, 1996

[30] Foreign Application Priority Data

Jul. 15, 1996 [SE] Sweden ..... 9602782

[51] Int. Cl.[6] ..... F15B 13/04

[52] U.S. Cl. ..... 91/424; 60/399; 137/110; 251/26

[58] Field of Search ..... 137/487.5, 110; 91/424; 60/399; 251/26

[56] References Cited

U.S. PATENT DOCUMENTS

| | | | |
|---|---|---|---|
| 3,605,554 | 9/1971 | Philbrick | 91/424 |
| 3,813,021 | 5/1974 | Kramer . | |
| 3,933,065 | 1/1976 | Janu et al. . | |
| 4,041,842 | 8/1977 | Stunkel | 91/424 |
| 4,138,005 | 2/1979 | Schneider et al. . | |
| 4,227,547 | 10/1980 | Cameron | 91/424 |
| 4,257,455 | 3/1981 | Cameron . | |
| 4,291,613 | 9/1981 | Porter . | |
| 4,354,270 | 10/1982 | Nuding . | |
| 4,542,767 | 9/1985 | Thornton et al. . | |
| 4,706,548 | 11/1987 | Baldauf | 91/424 |
| 5,113,907 | 5/1992 | Russell | 91/424 |
| 5,168,173 | 12/1992 | Windsor . | |
| 5,235,217 | 8/1993 | Kirton . | |

FOREIGN PATENT DOCUMENTS

| | | |
|---|---|---|
| 0 497 450 A1 | 8/1992 | European Pat. Off. . |
| 0 558 976 B1 | 7/1995 | European Pat. Off. . |
| 2 002 890 | 7/1971 | Germany . |
| 27 56 240 | 6/1979 | Germany . |
| 29 03 702 | 10/1979 | Germany . |
| 28 39 341 | 3/1980 | Germany . |
| 30 28 196 A1 | 2/1982 | Germany . |
| 32 30 056 A1 | 2/1984 | Germany . |
| 35 29 802 A1 | 2/1987 | Germany . |
| 42 21 756 A1 | 1/1994 | Germany . |

OTHER PUBLICATIONS

Copy of European Search Report dated Apr. 4, 1997.

RESK 2563.1E Apr. 1990 "SEPAR® Crossflow Double Valves with Pressure Switches", Ross Europa GmbH, 1 page.

*Primary Examiner*—Denise L. Ferensic
*Assistant Examiner*—Ramyar Farid
*Attorney, Agent, or Firm*—Harness, Dickey & Pierce, P.L.C.

[57] ABSTRACT

A control device for controlling and monitoring two fluid valves, wherein each fluid valve comprises a drive means which is adapted for activation by an associated control signal, and a movable valve element which is biassed toward a first position in which fluid flow through the valve is prevented and which can be driven by said drive means to a second position in which fluid is able to flow through the valve, a first switch which is actuable by the displaceable element of the first valve, a second switch which is actuable by the displaceable element of the second valve, wherein each switch is biassed towards a first position and each switch can be driven to a second position when the displaceable element of the associated valve takes its second position.

9 Claims, 3 Drawing Sheets

CONTROL DEVICE

The invention relates to a control device for controlling and monitoring two fluid valves, wherein each fluid valve comprises a drive means which is arranged to be activated by an associated control signal, and a displaceable valve element which is biassed towards a first position in which fluid flow through the valve is prevented and which can be driven by the drive means to a second position in which fluid flow through the valve is permitted, a first switch which is arranged to be activated by the displaceable element of the first valve, a second switch which is arranged to be activated by the displaceable element of the second valve, wherein each switch is biassed towards a first position and each switch is arranged to be driven to a second position when the displaceable element of the associated valve takes its second position.

The control device is of the kind which is adapted to ensure that drive means can be driven to and held in activated positions by a respective control signal solely providing that both control signals are applied within a predetermined time period and then both maintained. Each drive means includes a displaceable element which in a non-activated state of said drive means is biassed towards a first inactive normal position and which is movable to a second active position upon activation of the drive means in response to its associated control signal.

The drive means may consist of compressed air valves, for instance.

A control device of this kind finds use, for instance, in a so-called twin valve used to control the supply of compressed air to the brake of an eccentric clutch of a machine tool, such as an eccentric press. The control device may, for instance, be coupled to a two-hand control means for controlling the supply of compressed air. In this case, it is necessary for the operator to actuate two separate control-signal applying contacts essentially simultaneously with both hands. The two aforesaid elements. The aforesaid two elements may then be comprised of or connected to valve units which allow compressed air to be delivered to the eccentric press when activated. The twin valve will normally also include evacuation valves which are controlled by the two valve units. In order to close the evacuation valves and therewith allow compressed air to pass to the working cylinders of the press through the valve arrangement, it is necessary that the two valve units open rapidly and essentially simultaneously.

However, it will be understood by the person skilled in this art that the inventive control device can be used with other types of magnetically maneuvered elements.

So that the invention will be more readily understood and features thereof made apparent, the invention will be described in the following with reference to a so-called twin valve which controls the flow of pressurized fluid to a machine tool where there is a risk of injury to the person or persons in attendance, wherein the twin valve is controlled by two control signals which, e.g., can be established with the aid of two electric switches which must be actuated simultaneously with each hand of the operator in order to open the flow of compressed air to the machine tool.

Rules, legislation and regulations require the valve arrangement to be designed so that malfunctioning of a component in the valve arrangement will not cause further movement in the machine tool. The control system shall also ensure that a new machine working cycle (press cycle) cannot be initiated after a valve component has become defective. The time taken to stop the machine tool during a working cycle (working stroke) in the event of a valve malfunction shall not be of such duration as to place the machine operator at risk.

It is known that these requirements can be fulfilled by delivering pressurized fluid/compressed air to an eccentric press, for instance, through the medium of a so-called double valve. Such double valves are well known to the art. An example of earlier known double valves is found in the valve retailed by Ross Europa GmbH, D-6070 Langen, Germany, under the designation Serpare cross flow double valve.

Such known double valves/twin valves include two valve units which are normally closed and each of which is moved to an open position by a respective electromagnet in response to control signals applied to said magnets. The valve units are constructed and arranged to lie in series, for instance with respect to the compressed air supply to the consumer. The twin valve also normally includes two evacuation valves which are normally open and which are closed by the valve units as said valve units open. The evacuation valves may be connected in parallel to a drain or exhaust means. It is therefore necessary for the valve units to be opened simultaneously, in order to prevent the compressed air supplied from being evacuated to the drain. Simultaneous opening and closing of the two valve units is monitored by sensing the air pressures in respective valve units when their associated valve elements have begun to open and close respectively. This enables the two air pressures to be mutually compared, wherewith the valve arrangement enables compressed air to pass through the valve units when the sensed pressures are essentially equal to one another and are applied simultaneously. It is known to use for this monitoring process a single cylinder which is divided by a piston into two chambers to which pressure is delivered from an associated valve element. Movement of the piston will result in the electric signal to at least one electromagnet being interrupted, therewith preventing compressed air from being delivered to the machine tool. Another known monitoring system includes two cylinders which are each spring-biassed towards one end position and which are coupled to the pressure in respective valve units such that the position of the piston will give an indication of the pressure in the valve unit, i.e. that the valve unit has begun to open. An electronic monitoring device/logic is adapted to ensure that the electromagnets are prevented from holding the valve units open when the time difference between the pressurization of the valve units exceeds a predetermined value, with the guidance of the two sensed, pressure-controlled piston movements to this end.

Also known to the art is a similar arrangement which includes electric pressure-controlled switches that are switched from one state to another when the pressure in respective valve units corresponds to the supply pressure, said switches controlling the external electromagnetic monitoring arrangement. Such an external electronic monitoring arrangement is expensive and requires signal processing facilities, and is also able to introduce further fault sources that cannot easily be overcome.

Accordingly, an object of the present invention is to provide a control device that can be readily built-up on a terminal block without requiring signal processing monitoring logic, wherein the actual control device/terminal block can be conveniently fitted, for instance, to a double valve which is to be controlled by said device, such that only those control signal lines that include the inventive control device need be connected to the unit.

This object is achieved with the control device defined in claim 1.

Further developments of the invention are set forth in the dependent Claims.

The invention will now be described in more detail with reference to exemplifying embodiments thereof and also with reference to the accompanying drawings, in which FIG. 1 illustrates schematically a circuit diagram for an inventive control device as applied in the schematically illustrated and simplified double valve, for controlling a pneumatically controlled clutch and brake of a mechanical eccentric press, for instance;

Figure 1:
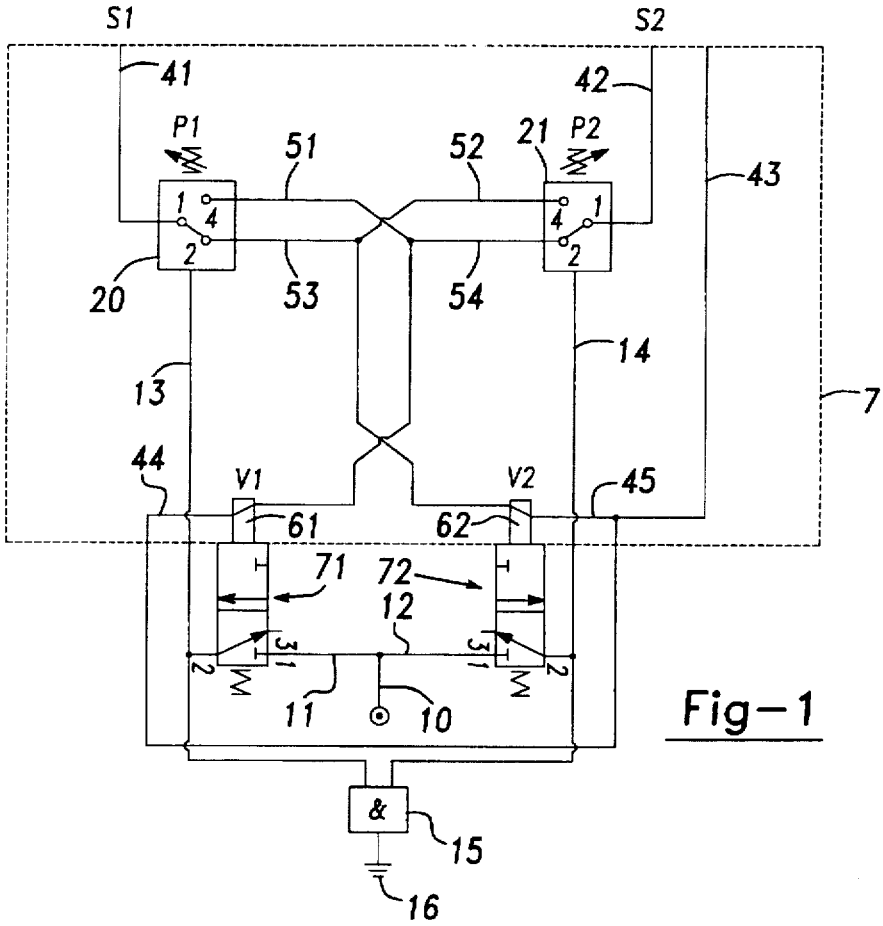

Shown in FIG. 1 is the inlet end 10 of a compressed air line whose outlet end 16 delivers compressed air to a machine tool, such as an eccentric press. Extending between the ends 10, 16 are two parallel branch lines 11, 12, each including a respective valve 71, 72 of mutually the same design. The valves 71, 72 are normally closed, but can be displaced against the action of a spring to allow fluid to flow to an "AND"-function 15 which will allow compressed air to be delivered to the machine tool connected to the outlet 16 when both valves 71, 72 open essentially simultaneously. The illustrated AND-function is a simplification intended to facilitate an understanding of the modus operandi of the inventive device. In practice, the AND-function 15 may be comprised of the valve arrangement and the flow coupling shown in FIG. 2.

Each of the valves 71, 72 can be displaced to its open position by a respective electromagnet 61 (V1) and 62 (V2).

A fluid-pressure controlled electric switch 20 (P1) senses the pressure prevailing between the valve 71 and the valve 15 via a line 13. The switch 20 has an input terminal 1 which is connected to a control signal source SI via a line 41. The switch 20 has two output terminals 2, 4. When the pressure in the line 13 overcomes the spring force in the switch 20, the terminal 1 is connected to the output terminal 4. Otherwise, the terminal 1 is connected to the output terminal 2. The switch terminal 4 is connected to the magnet 61 by a line 51, and, via the solenoid of the magnet, to the line 44 which is connected to the line 43 and minus potential (the signal source S1 is assumed to be plus potential). When the pressure in the line 13 switches the switch 20 to the output terminal 4, the control signal S1 will thus energize the electromagnet 61 so that compressed air is able to flow to the "AND"-valve function 15 through the line 11.

It will be evident from the aforegoing that, basically, when the pressure in the line 13 exceeds a certain chosen pressure limit, the switch will be switched from its normal nonactivated position to its activated position, either directly or indirectly. The switch is often loaded by a spring which biases the switch towards its normal position.

A fluid control switch 21 (P2) senses the pressure prevailing between the valve 72 and the "AND"-valve 15 via a line 14. The switch 21 has an input terminal 1 which is connected to a control signal source S2 via a line 42. The switch 21 has two output terminals 2, 4. When the pressure in the line 14 overcomes the spring force in switch 20, the input terminal 1 is connected to the output terminal 4. Otherwise, the input terminal 1 is connected to the output terminal 2. The terminal 4 of switch 21 is connected to the unit 62 (V2) of said valve (72) via a line 52, and, via the magnet solenoid, to the line 45 connected to the line 43 and minus potential or 0-conductor. Thus, when the pressure in line 14 switches the switch 21 to terminal 4, the control signal S2 will energize the magnet 62 so that compressed air is able to flow to the "AND"-valve 15 through the line 12.

The terminal 2 of switch 20 is connected to the line 52 via the line 53. The output terminal 2 of the switch 21 is connected to line 51 via a line 54. The output terminals 2, 4 of the two switches 20, 21 are thus permanently connected crosswise to one another.

in the case of both switches 20, 21, the input terminal 1 is held connected to its output terminal 2 provided that the magnets 61, 62 have not been moved from their normal end position, i.e. provided that the valves 71 and 72 have not been moved to their respective open end position. When the magnets 61, 62 and the valves 71, 72 are actuated for movement to their respective other end positions, the input terminals 1 of respective switches 20, 21 will be connected to the output terminals 4.

As shown in the part of FIG. 1 framed in broken lines, the control device 7 functions such that the control signals S1, S2 must be applied essentially simultaneously in order for the magnets 62 and 61 to be actuated to their respective active end positions. And when the magnets 61, 62 are in their activated end positions, the switches 20, 21 are actuated so as to switch states and supply current to the magnets 61 and 62 respectively. However, this switch from one state to another assumes that the inertia of the magnets 61, 62 (the valves 71, 72) is so high that the magnets have insufficient time to leave their activated end position in the time period during which the supply of current to the magnets switches from one control signal to the other. The valve resetting means (e.g. the springs) that bias respective valves towards their normal positions therefore do not have sufficient time to drive the valves away from their activated end position during the time taken for the switch to switch over.

In FIG. 1, the magnets 61, 62 have been assumed to drive the valves 71, 72 directly, for the sake of simplicity. It will be understood, however, that in practical embodiments the valves 71, 72 may be driven by pilot valves in a conventional manner.

An important advantage afforded by the control device 7 is that no monitoring logic is required to sense instantaneousness of the valves 71, 72 (the magnets 61, 62). It is sufficient to couple the switches 20, 21 in the illustrated manner.

It will be evident that the switches 20, 21 need not necessarily be controlled by pressure via fluid lines 13, 14. For instance, the switches 20, 21 can be controlled mechanically by movement of the magnets 61, 62 (or the valves 71, 72). Alternatively, switching of the switches 20, 21 can be controlled by sensing movement of magnets (or valves) electrically.

It will also be evident that the magnets 61, 62 need not control fluid valves, but may also control other types of control means where it is important that movement of the magnets 61, 62 to an active position takes place essentially simultaneously in response to the essentially simultaneous application of the control signals S1 and S2 for respective magnets.

Figure 2:
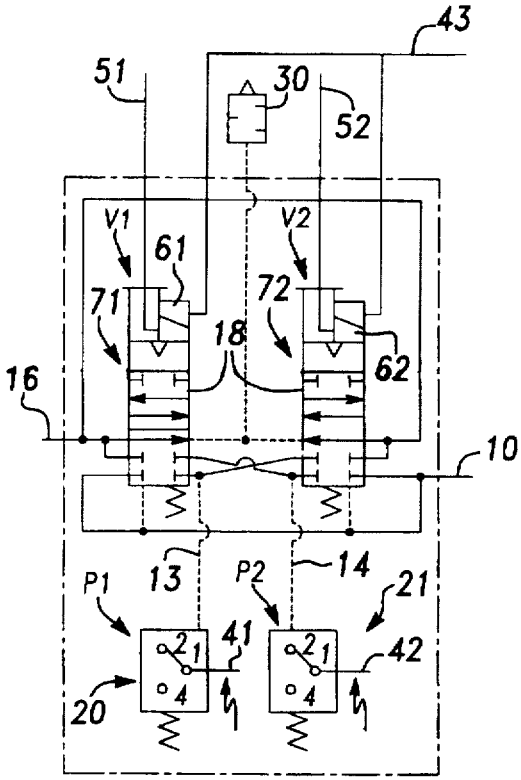
FIG. 2 is a diagrammatic illustration of a known double valve.

FIG. 2 is a diagrammatic illustration of a double valve, or twin valve, sold by Ross Europa GmbH, D-6070 Langen, Germany. The illustrated valve is a "Serpar® cross flow double valve with pressure switches", illustrated in leaflet RESK 256.1E04/90.

The illustrated circuit has been supplemented with signal lines 51, 52 for the control signals applied to the magnets 61, 62 that manoeuver the valves 71, 72. The valves 71, 72 of the FIG. 2 embodiment are of the kind that are seriesconnected in a forwarding direction and parallel-connected in a direction towards a drain 30.

The "AND"-function 18 in FIG. 2 corresponds generally to the "AND"-function 15 shown in FIG. 1 and includes two valve elements which in the FIG. 2 embodiment are carried by the valves 71, 72 and close the fluid path to the drain 30 when the valves 71, 72 are actuated to their active end positions. When the valve 18 closes its respective drain ports simultaneously, the pressure has insufficient time to fall to such a low level as to cause the switches 20, 21 to switch and cause closing of the double valve.

The switches 20, 21 deliver output signals from their respective terminals 4 when the pressure from the line 10 is sensed in respective valves 71, 72, i.e. when the supply pressure 10 is sensed in the valve units 71, 72 after said units have begun to open and the passage to the drain 30 has been blocked by the drain valves 18.

Figure 3:
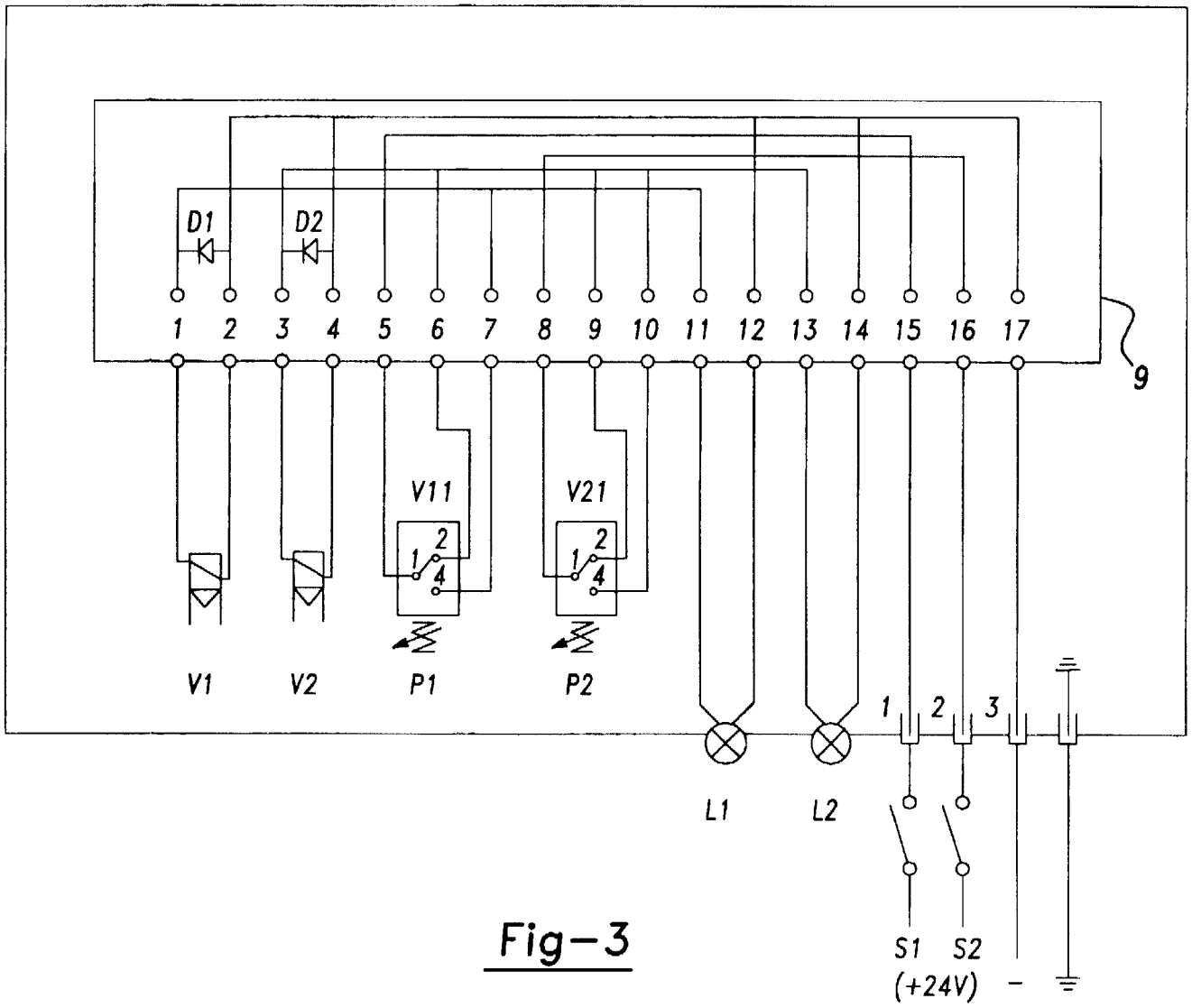
FIG. 3 illustrates the inventive control device when applied to the double valve shown in FIG. 2.

In accordance with the invention, the inventive control device 7 (see FIG. 1) can be established in a known "twin valve", by virtue of connecting the electromagnets V1, V2 and the switches P1, P2 to respective signal sources S1, S2 and coupling the magnets and switches together on a terminal block 9 as illustrated in FIG. 3 (in which the number series 1–17 denotes numbering of the port coupling positions). Indicator lamps L1, L2 may also be connected to the terminal block 9 and caused to light up when the switches P1 and P2 switch to terminal 4.

Protective diodes D1 and D2 may be conveniently mounted on the terminal block 9 in parallel with the magnets V1 and V2 respectively.

The advantage afforded by building up the control device 7 on a simple terminal block 9 is that the block can then be readily fitted to a twin valve corresponding to FIG. 3. The control device, i.e. the terminal block 9, is relatively inexpensive to produce and can therefore be fitted to the twin valve and replaced together with said valve.

Thus, in an inventive double valve, the control device will monitor and eliminate further valve functions and prevent a restart (and possibly also indicate the occurrence of a fault with the aid of lamps L1, L2), when

- one of the two valve elements 71, 72 remains in an open or a closed position;
- one of the two switches remains in an activated or nonactivated state;
- one of the control signals remains or is excluded;
- the asynchronism of the control signals is greater than a set value (e.g. about 50 ms);
- the asynchronism of the switches is greater than the aforesaid value; and
- the asynchronism of the valve elements 71, 72 is greater than the aforesaid value.

As an alternative to the electrical control device shown in FIGS. 1–3, the inventive control device may have a pneumatic or hydraulic design.

Figure 4:
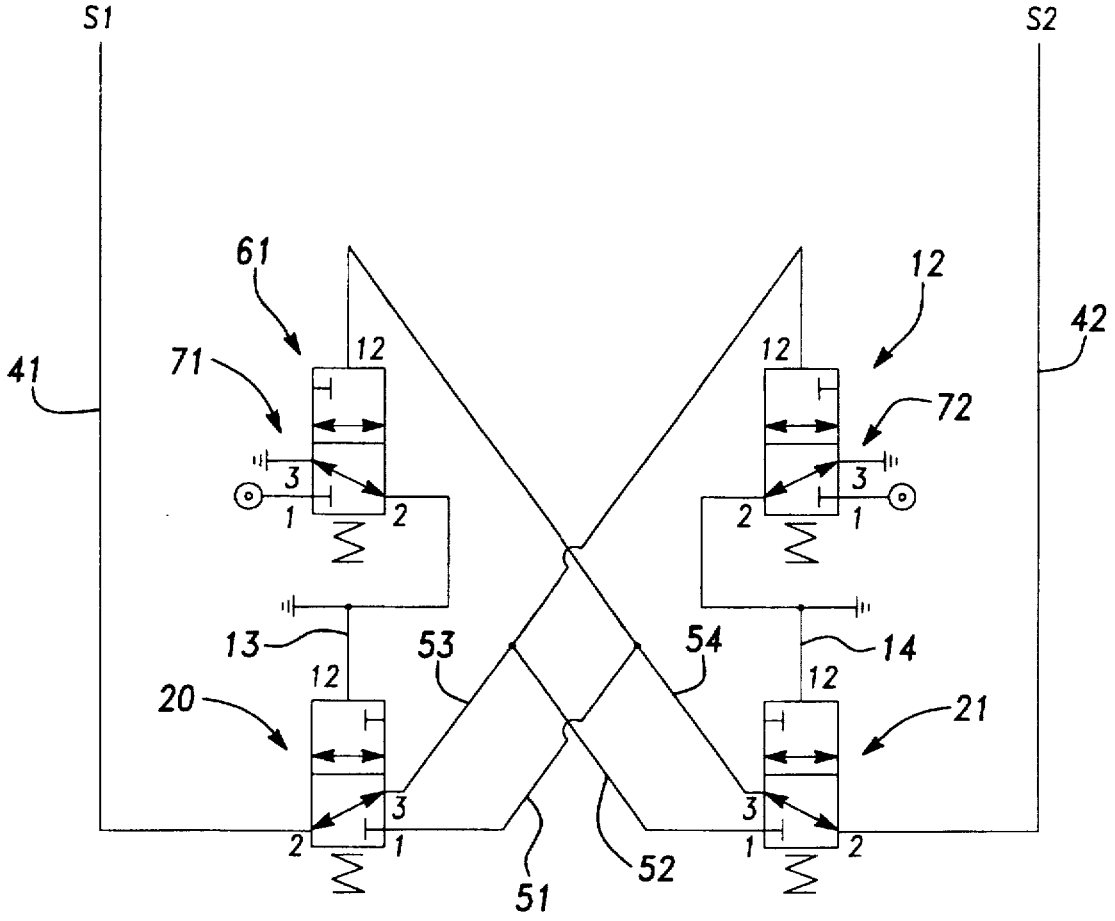
FIG. 4 illustrates a pneumatic control device according to the present invention.

Those features shown in FIG. 4 that find correspondence in FIGS. 1–3 have been identified by the same reference signs.

It will be seen from FIG. 4 that the control signals are initially passed through a respective non-activated switch 20, 21 to the valve drive means 62, 61 via the lines 53, 54, so that the valve 72 will be switched by the signal S1 and the valve 71 will be switched by the signal S2 and permit air to pass through. The air that passes through the one valve will switch the other switch 21, 20 so that compressed air is instead passed to the lines 53 and 54 through respective lines 51, 52, and such that the signal S1 and S2 will now actuate respective drive means 61 and 62 instead. It will be seen that the switches must be switched essentially simultaneously in order for the valves 71, 72 to be able to remain open. Should one of the valves 72, 71 be able to close while the switch 20 or 21 switches over, it is necessary for the control device to return to its normal state and then again apply the signals S1 and S2 essentially simultaneously.

As with the embodiment shown in FIGS. 1–3, it is important that the control device shown in FIG. 4 is constructed in a manner such that the switches will directly influence the control signals, such that the control signals will be applied to the drive means for activation of said means when both switches occupy their first position and such that the control signals will remain applied to the drive means when both switches occupy their second positions, and also such that when the switches take mutually different switch positions within a predetermined time period, the applied control signal is eliminated so as to cause the valve controlled by said signal to return to its inactive position.

In the case of the FIG. 4 embodiment, the valves 71, 72 may, in principle, be considered to constitute the two valve parts of a conventional so-called twin valve. It will be obvious to the person skilled in this art that such a twin valve may be of conventional construction and thus include components that are additional to the components illustrated in FIG. 4.

It will also be understood that embodiments other than those described and illustrated are also possible within the scope of the present invention.

The essential feature of the invention is that the switches are able to directly influence the control signal paths so as to prevent a control signal from opening an associated valve when the time lag of the control signal relative to the first of the two signals that must be applied is excessive and the control signals therewith no longer essentially simultaneous, therewith requiring the control device to be reset to its starting position before a new attempt to apply the two control signals within the predetermined time period can be made.

In an alternative embodiment, the two switches can be connected so that when one switch has been brought to its second position as a result of activation of the second valve, it can eliminate application of a control signal to the first valve as when activating switching of the second switch to its second position.

The one switch is thus adapted to initially conduct a first control signal to one valve which, when actuated, switches a second switch to a second position. A second switch is adapted to conduct initially in its first position a second control signal to the first valve, which is thereby switched to a second position and therewith switches the first switch to its second position. The two switches are therewith connected to allow the two control signals to continue holding the valves in their active second end positions only provided that the time difference between switching of the switches to their respective second positions is shorter than a predetermined value, this value conveniently being defined by the time taken to switch one valve from its second position to its first position.

We claim:

1. A control system for controlling and monitoring a pair of first and second pneumatic valves, said first and second valves including respective first and second drive means each activated by a control signal, said first and second valves further including respective first and second movable valve elements each of which is biased toward a first valve position permitting fluid flow through its respective one of said first and second valve, said drive means of each valve driving each of the respective first and second movable valve elements of said respective first and second valves toward a second valve position preventing fluid flow through the respective valve;

said control system including first and second switches each of which is biased toward a first position, said first switch being actuable to a second switch position by movement of the movable valve element of said first valve to its second valve position, and said second switch being actuable to a second switch position by movement of the movable valve element of said second valve to its second valve position;

said control system further including control means interconnected with said switches for preventing a first control signal from being applied to said first valve when said first valve element is in its first valve position and a first predetermined time period has elapsed after said second valve element is moved to its second valve position, said control means further preventing a second control signal from being applied to said second valve when said second valve element is in its first valve position and a second predetermined time period has elapsed after said first valve element is moved to its second valve position;

said control means further being interconnected with said switches to permit said first and second control signals to be applied to said respective first and second drive means when both of said switches are simultaneously in their first positions and when both of said switches are simultaneously in their second positions;

the first switch being interconnected to conduct the first control signal to the second valve when the first switch is in its first switch position and therewith permit said valve to take its second valve position and to switch the second switch to its second switch position; the second switch being interconnected to conduct the second control signal to the first valve when the second switch is in its first switch position so as to permit said first valve to take its second valve position and to switch the first switch to its second switch position; the first switch being interconnected to conduct the first control signal to the first valve when the first switch is in its second switch position; and the second switch being interconnected to conduct the second control signal to the second valve when the second switch is in its second switch position; and each of said switches changing between said respective first and second switch positions every time said first and second valve elements move between said respective first and second valve positions.

2. A control device according to claim 1, characterized in that said predetermined time periods are defined by the time taken for the respective first and second valve elements to move between their first and second valve positions.

3. A control device according to claim 1, characterized in that the predetermined time period is defined by the time taken for the respective first and second valve elements to return from their respective second valve positions to their respective first positions.

4. A control device according to claim 1, characterized in that the first and second switches are switched by the fluid pressure on the output of respective valves.

5. A control device according to claim 1, characterized in that the first and second valves together form a twin valve.

6. A control device according to claim 1, characterized in that the control device is a pneumatic control device.

7. A control device according to claim 1, characterized in that the control device is an electrical control device.

8. A control device according to claim 1, characterized in that the two switches are connected to permit both control signals to continuously hold both of said valves in their respective active second positions so long as the time difference between said switching of the first and second switches to their respective second position is shorter than said predetermined value.

9. A control device according to claim 8, characterized in that the predetermined time period is defined by the time taken for one of the valves to move from its second position to its first position.

* * * * *

UNITED STATES PATENT AND TRADEMARK OFFICE

CERTIFICATE OF CORRECTION

PATENT NO. : 5,799,561

DATED : September 1, 1998

INVENTOR(S) : Wetzel, et al

It is certified that error appears in the above-identified patent and that said Letters Patent is hereby corrected as shown below:

On the Title Page under Other Publications, line 2, "SEPAR®" should be --SERPAR®--.

Column 2, line 10, "Serpare" should be --Serpar®--.

Column 4, line 9, "in" should be --In--.

Signed and Sealed this

Fifteenth Day of December, 1998

*Attest:*

*Attesting Officer*

BRUCE LEHMAN

*Commissioner of Patents and Trademarks*